United States Patent [19]

Arnold

[11] 3,953,624

[45] Apr. 27, 1976

[54] METHOD OF ELECTROLESSLY DEPOSITING NICKEL-PHOSPHORUS ALLOYS

[75] Inventor: Anthony Francis Arnold, Ringoes, N.J.

[73] Assignee: RCA Corporation, New York, N.Y.

[22] Filed: May 6, 1974

[21] Appl. No.: 467,136

[52] U.S. Cl. ..... 427/256; 29/196.6; 106/1; 427/92; 427/305; 427/438

[51] Int. Cl.[2] ..... C23C 3/02

[58] Field of Search ..... 117/130 E, 47 A; 106/1; 427/92, 305, 256, 438

[56] References Cited

UNITED STATES PATENTS

| | | | |
|---|---|---|---|
| 2,658,842 | 11/1953 | Gutzeit et al. | 117/130 E |
| 2,772,183 | 11/1956 | Talmey et al. | 117/130 E |
| 2,822,294 | 2/1958 | Gutzeit et al. | 117/130 E |
| 2,935,425 | 5/1960 | Gutzeit et al. | 117/130 E |
| 3,138,692 | 6/1964 | Bakker et al. | 117/130 E |
| 3,325,297 | 6/1967 | Talmey et al. | 106/1 |

OTHER PUBLICATIONS

Pearlstein, "Modern Electroplating", Chapter 31 pp. 712, 713, 714, 715, 720, 721, c1974.

*Primary Examiner*—Ralph S. Kendall
*Assistant Examiner*—John D. Smith
*Attorney, Agent, or Firm*—Glenn H. Bruestle; Arthur E. Wilfond; William S. Hill

[57] ABSTRACT

Nickel-phosphorus alloys are electrolessly deposited such that initial deposition takes place at a relatively rapid rate and at a particular acid pH, then when the nickel content of the bath has dropped to a low level, pH drops rather abruptly and the final material deposited has a high phosphorus content relative to the layers initially deposited. In this method the phosphorus content of the surface layers is closely controlled to maintain uniform behavior of the plating in subsequent soldering, wire-bonding and welding operations.

4 Claims, No Drawings

METHOD OF ELECTROLESSLY DEPOSITING NICKEL-PHOSPHORUS ALLOYS

BACKGROUND OF THE INVENTION

Electroless deposition methods are now widely used in industry to deposit metals such as nickel and copper on a wide variety of insulating or conducting substrates. In general, deposition baths contain a salt of the metal to be deposited, a reducing agent capable of reducing the metal salt to metal, a chelating agent to control the reduction process and a pH-adjusting agent. Other substances such as stabilizers and wetting agents may also be present in the baths.

One of the most commonly used reducing agents in nickel-depositing baths is sodium hypophosphite. This reducing agent enables a desirably high rate of deposition to be achieved. However, in hypophosphite type baths, the metal that is deposited is alloyed with a certain percentage of phosphorus. For some purposes, such as the coating of plastics with nickel for decorative purposes, the percentage of phosphorus in the deposit is of no particular importance. But, if the nickel is being deposited on headers or heat sinks used in semiconductor devices, the percentage of phosphorus in the nickel is critical because it affects the solderability of the coated surface. Many commercial baths for depositing nickel and including a hypophosphite as the reducing agent have been found not to be suitable for plating on semiconductor devices because the nickel has variable solderability and other undesirable properties. This is due, in major part, to the phosphorus content of the surface layers of the deposited nickel-phosphorus alloy.

In the past, most electroless metal plating methods have been directed toward providing a continuous process including periodic replenishment of the bath with metal salt, reducing agent and any other ingredients, such as the pH-adjusting agent, that get used up in the process. Continuous plating is usually more economical in large volume production. However, in the electronics industry, reproducibility and uniformity of the plated surface throughout the production cycle is of primary importance. If the solderability or bondability of the plated surface keeps changing during assembly of semiconductor devices, the production results are often adversely affected to an extent that cannot be tolerated.

In order to provide greater uniformity and reproducibility of a nickel plated surface, the present method utilizes a process in which the metal content of the bath is allowed to become depleted to a low value at the end of each production run. The bath is discarded at the end of each production run and a new bath is made up for a new run. This produces a high level of consistency at a low cost in the initially used chemicals.

The present method also provides an initially high plating rate that holds for most of the plating run. Then the plating rate drops off rapidly, corresponding to an abrupt drop in pH, and an increase in the phosphorus content of the deposited coating to a controlled level. These results are achieved by providing buffers in the form of lactates and acetates (or other aliphatic carboxylic acid salts). The buffers provide an initially high plating rate, a relatively high initial acid pH and a relatively low initial phosphorus content in the deposit. The lactate also imparts good bath stability.

A glycolate is used to adjust the final pH of the bath. Too much glycolate prevents the pH from dropping to as low a level is desired. The correct amount of glycolate to use also depends on the concentration of hypophosphite and lactate. Under some conditions, the glycolate can be omitted entirely. A malate can also be used in place of the glycolate.

DESCRIPTION OF PREFERRED EMBODIMENT

EXAMPLE 1

The following is an example of the present method as used to plate a catalytic surface, such as steel or copper, having an area of 6450 sq. cm. (1000 sq. in.) with a layer of nickel-phosphorus alloy having a thickness of 2 microns. An aqueous solution is prepared having the following composition. Deionized water is used as the solvent.

| | |
|---|---|
| $NiSO_4.6H_2O$ | 0.024 moles/liter |
| $NaH_2PO_2.H_2O$ | 0.06 moles/liter |
| KOH | 0.056 moles/liter |
| Lactic acid | 0.0083 moles/liter |
| Acetic acid | 0.04 moles/liter |
| Potassium glycolate ($CH_2OHCOO)K$ | 0.013 moles/liter |
| Solution pH | 5.7 (approximately) |

Semiconductor device parts to be plated are immersed in the solution, which is maintained at 80° C, for one hour. At the end of one hour, the pH of the solution has fallen to 3.75 ±0.10.

The surface layers of the plating which is deposited have a phosphorus content of about 11% by weight. This is close to the eutectic composition.

Typical acceptable variations in this Example are ± 2° C in temperature and ± 10 minutes in time.

EXAMPLE 2

Somewhat thicker nickel-phosphorus alloy coatings than 2 microns are required in some applications in order to provide sufficient corrosion resistance. The following bath provides a coating of at least 2.5 microns on the same area as Example 1 (6450 sq. cm.). In this Example, an aqueous bath is prepared with the following composition.

| | |
|---|---|
| $NiSO_4.6H_2O$ | 0.035 moles/liter |
| $NaH_2PO_2.H_2O$ | 0.094 moles/liter |
| KOH | 0.08 moles/liter |
| Lactic acid | 0.012 moles/liter |
| Acetic acid | 0.058 moles/liter |
| Potassium glycolate | 0.0037 moles/liter |
| Solution pH | 5.7 |

Semiconductor device parts which are immersed in this bath, receive a plating of about 2.5 microns of nickel-phosphorus alloy having a surface concentration of phosphorus of about 11% by weight, in one hour. Bath temperature is 80° C. The pH of the bath drops to about 3.7 in one hour. If a higher plating temperature is used, the time to completion of this plating decreases.

The bath ingredients may be varied as follows. Nickel salt concentration may be about 0.02 to 0.04 moles/liter. However, for storage purposes, concentrated solutions may be used containing up to about 0.25 moles/liter. The concentrate is diluted when used. If the nickel concentration is too high in the operating bath, the stability of the bath decreases. The nickel compound may be a salt of any non-oxidizing, non-chelating, acid. At the end of the plating run, it is preferred that the nickel content of the bath be about 10% or less of the original concentration.

The hypophosphite may be present in a ratio of 2 to 3.2 moles per mole of nickel salt. The hypophosphite may be introduced as any alkali metal hypophosphite, or as hypophosphorous acid plus equivalent neutralizing alkali.

Instead of acetic acid, any other aliphatic carboxylic acid or alkali metal salt of such acid may be used. Where monobasic acids or acid salts are used, the amount is in a ratio of about $0.6 \pm 0.15$ mole per mole of hypophosphite. Where the material is a dibasic acid such as adipic acid or an alkali metal salt of a dibasic acid, the corresponding amount is $0.3 \pm 0.07$ moles per mole of hypophosphite.

Instead of lactic acid, any alkali metal lactate may be used. This material may be present in a ratio of about 0.1 to 1.0 mole, per mole of nickel salt present. A preferred ratio is about 0.5 mole of lactate per mole of nickel. The maximum permissible concentration of lactic acid in the plating bath is determined by its buffering effect at the end of the plating cycle. 0.05 molar lactate has been found sufficient to buffer the final pH to 4.0 or more for the prepared formulations. Maximum permissible concentration is about 0.055 molar.

The glycolate (hydroxyacetate) is present to stabilize the pH at the end of the plating cycle. Any alkali metal glycolate or malate may be used in an amount of 0 – 0.015 moles/liter. Glycolic acid or malic acid can also be used.

The alkali may be any alkali metal hydroxide, or ammonium hydroxide, in an amount sufficient to provide an initial pH of about 4.5 to 7 in the bath.

At the end of the plating run, the bath is discarded. None of the ingredients is replenished during the plating run.

The plating bath is preferably maintained at a temperature of 80° – 95° C.

I claim:

1. A method of electrolessly depositing nickel-phosphorus alloys on a catalytic surface, comprising:

treating said surface with an aqueous bath comprising about 0.02 to 0.04 moles per liter of a nickel salt of a non-oxidizing, non-chelating acid, an alkali metal hypophosphite in an amount of 2 to 3.2 moles per mole of nickel salt, lactic acid or an alkali metal lactate in an amount of 0.1 to 1.0 mole per mole of nickel salt not exceeding a total concentration of 0.055 moles/liter, an aliphatic carboxylic acid or alkali metal salt of such acid in an amount of $0.6 \pm 0.15$ mole per mole of hypophosphite in the case where a monobasic acid is used, and $0.3 \pm 0.07$ mole per mole of hypophosphite in the case where a dibasic acid is used, an alkali metal glycolate or malate in an amount of 0 to 0.015 mole per liter and sufficient alkali metal hydroxide or ammonium hydroxide to provide an initial pH of about 4.5 to 7, at a temperature of about 80° – 95° C, continuing the treatment until the pH drops to a level of about $3.75 \pm 0.10$ and the nickel content of the bath is about 10% or less of the initial concentration, and terminating the treatment without replenishing any of the ingredients.

2. A method according to claim 1 in which said plating bath contains $NiSO_4.6H_2O$ in a concentration of 0.024 moles per liter, $NaH_2PO_2.H_2O$ in a concentration of 0.06 moles per liter, lactic acid in a concentration of 0.0083 moles per liter, acetic acid in a concentration of 0.04 moles per liter, potassium glycolate in a concentration of 0.013 moles per liter and KOH in a concentration of 0.056 moles per liter, and said bath is at a temperature of about 80° C, with time of treatment being about one hour.

3. A method according to claim 1 in which said plating bath contains 0.035 moles/liter of $NiSO_4.6H_2O$, 0.094 moles/liter of $NaH_2PO_2.H_2O$, 0.08 moles/liter of KOH, 0.012 moles/liter of lactic acid, 0.05 moles/liter of acetic acid, 0.0037 moles/liter of potassium glycolate, the original solution pH is about 5.7, said bath is at a temperature of about 80° C and treating time is about one hour.

4. A method of electrolessly depositing a non-homogeneous layer of nickel-phosphorus alloys on a catalytic surface, comprising:

treating said surface with an aqueous bath comprising a nickel salt of a non-oxidizing, non-chelating acid, hypophosphite ion in an amount of 2 to 3.2 moles per mole of nickel salt, lactic acid or an alkali metal lactate in an amount of 0.1 to 1.0 mole per mole of nickel salt not exceeding a total concentration of 0.055 moles/liter, an aliphatic carboxylic acid, an alkali metal hydroxide or ammonium hydroxide and a hydroxyacetic acid or an alkali metal salt thereof, wherein the initial nickel content of the bath is about 0.02 to 0.04 moles per liter, the remaining ingredients, other than nickel, are present in such proportions as to provide an initially high plating rate at a relatively high initial acid pH of about 4.5 to 7, the carboxylic acid is present in an amount to maintain the initially high pH until most of the nickel is depleted at which time the pH abruptly drops to a lower value which is determined by the ratio of hypophosphite to lactate and hydroxyacetate ions, and the nickel salt is sufficient to maintain a phosphorus deposition rate that drops more slowly than the nickel deposition rate, whereby the phosphorus content of the deposit rises as deposition proceeds after the abrupt drop in pH, continuing the deposition process until the pH drops to a level of about $3.75 \pm 0.10$ and the nickel content of the bath is about 10% of the initial concentration, and terminating the treatment without replenishing any of the bath ingredients.

* * * * *